US007210914B2

(12) United States Patent
Choi

(10) Patent No.: US 7,210,914 B2
(45) Date of Patent: May 1, 2007

(54) SERIES APPARATUS FOR FORMING LAYERED FIBROUS MAT OF DIFFERING FIBERS AND CONTROLLED SURFACES

(75) Inventor: Kyung-Ju Choi, County of Jefferson, KY (US)

(73) Assignee: AAF-McQuay Inc., Louisville, KY (US)

( * ) Notice: Subject to any disclaimer, the term of this patent is extended or adjusted under 35 U.S.C. 154(b) by 115 days.

(21) Appl. No.: 10/788,831

(22) Filed: Feb. 28, 2004

(65) Prior Publication Data

US 2005/0129793 A1 Jun. 16, 2005

Related U.S. Application Data

(62) Division of application No. 10/028,189, filed on Dec. 20, 2001, now Pat. No. 6,736,914.

(51) Int. Cl.
*B28B 5/00* (2006.01)

(52) U.S. Cl. ..... 425/72.2; 425/131.5; 425/382.2; 425/363; 156/178; 156/181; 156/441

(58) Field of Classification Search ..... 425/72.2, 425/131.5, 382.2, 363; 156/178, 181, 441
See application file for complete search history.

(56) References Cited

U.S. PATENT DOCUMENTS 2,875,503 A * 3/1959 Frickert et al. ..... 428/222
5,425,796 A * 6/1995 Loubinoux et al. ..... 65/442
5,628,844 A * 5/1997 Nishino et al. ..... 156/62.4
5,681,469 A * 10/1997 Barboza et al. ..... 210/503
6,596,205 B1 * 7/2003 Choi ..... 264/6
6,908,294 B2 * 6/2005 Choi ..... 425/131.5

FOREIGN PATENT DOCUMENTS

DE 0404982 * 1/1991 ..... 425/72.2
EP 0822282 * 2/1998 ..... 425/72.2
WO WO 02/43951 * 6/2002 ..... 425/72.2

* cited by examiner

*Primary Examiner*—Yogendra Gupta
*Assistant Examiner*—Maria Veronica Ewald
(74) *Attorney, Agent, or Firm*—Steve A. Witters; Middleton Reutlinger

(57) ABSTRACT

An arrangement for forming a web of fibrous media wherein at least one formed layered portion is attenuated from a first die source selectively unto a first collector and successively combining such portion with at least another formed layered portion which is attenuated from a second die source selectively unto a second collector, at least one of the outer surfaces of the web of fibrous media being of comparatively smooth skin-like nature to minimize projecting fiber ends.

20 Claims, 8 Drawing Sheets

SERIES APPARATUS FOR FORMING LAYERED FIBROUS MAT OF DIFFERING FIBERS AND CONTROLLED SURFACES

CROSS-REFERENCE TO RELATED APPLICATIONS

This application is a divisional of U.S. patent application Ser. No. 10/028,189, filed on Dec. 20, 2001, now U.S. Pat. No. 6,736,914, issued on May 18, 2004.

BACKGROUND OF THE INVENTION

The present invention relates to a method, apparatus and product relating to fibrous mat and more particularly to a unique and novel arrangement for making fibrous mat in such a combined manner that the resulting attenuated fibrous layered mat has fiber layers, each of select fiber size distribution and, if elected a controlled surface and variable permeability.

The present invention has particular applicability to polymer fibrous mat produced by melt blowing die apparatus but it is to be understood that the present invention can be readily utilized in layered mat production where in layered fibrous mats of other fibrous materials in addition to preselected polymer material—such as glass—are extracted in die attenuated form from heated die sources unto spaced collector sources.

Layered fibrous mat composed of fibers attenuated from a heated die source unto a space layered matt collector surface are generally well known in both the glass and melt blown arts but none have utilized the unique and novel unified arrangement disclosed herein. Although, as above-noted, the present invention is not be considered as limited to die feeding polymer materials from heated melt blown die sources, the unique and novel arrangement set forth herein has particular applicability in the melt blowing die feeding arrangements as disclosed in the U.S. Pat. No. 5,725,812, issued to Kyung-Ju Choi on Mar. 10, 1998; U.S. Pat. No. 5,891,482, issued to Kyung-Ju Choi on Apr. 6, 1999; U.S. Pat. No. 5,976,209, issued to Kyung-Ju Choi on Nov. 2, 1999; U.S. Pat. No. 5,976,427, issued to Kyung-Ju Choi, also on Nov. 2, 1999; U.S. Pat. No. 6,159,318, issued to Kyung-Ju Choi on Dec. 12, 2000; and U.S. Pat. No. 6,230,776, issued to Kyung-Ju Choi on May 15, 2001.

The external treatment of fibers with respect to a fiber collecting source is generally well known in the production of non-woven fabrics, attention being directed to U.S. Pat. No. 4,095,312, issued to D. J. Haley on Jun. 20, 1978, wherein fibers are collected from two fiber feeding sources to a pair of moving collecting surfaces to form a nip; to U.S. Pat. No. 4,100,324, issued to R. A. Anderson, et al. on Jul. 11, 1978, wherein wood pulp fibers are added to a matrix of collected polymeric melt blown microfibers; to U.S. Pat. No. 4,267,002, issued to C. H. Sloan on May 21, 1981, wherein fibers are formed in elongated rod shape with a heavy build-up in a central portion and a light build-up in a lip portion folded back over the central portion; to U.S. Pat. No. 4,375,446, issued to S. Fujii, et al. on Mar. 1, 1983, wherein melt blown fibers are collected in a valley-like fiber-collecting zone formed by relatively moveable and compressible porous plates which have a controlled number of pores; and, finally to U.S. Pat. No. 4,526,733, issued to J. C. Lau on Jul. 2, 1955, wherein a fluid stream of attenuated fibers is preselectively temperature treated upon exiting die tip orifices to provide improved collected web properties.

Although these above-noted patents disclose various external treatments of fiber streams attenuated from heated die sources, none teaches or suggests, either alone or in combination, the economical and straight-forward arrangement which includes successively feeding and combining fiber layers, each layer having select fiber size distributions and, if elected, the novel diversion and vortically creating force exertion of a selected portion of fiber streams to provide fiber layers with select fiber size distributions, selected surface, and, selected variable permeability of the total fibrous mat as it passes to a fiber collecting source.

The present invention provides a unique and novel die attenuated fiber arrangement including a straight-forward, economical and inventively unified production method, apparatus and final layered, relatively strong fibrous mat product which allows for efficient and economic control of fiber size distribution, surface, and permeability of a layered fibrous mat product which can have selected fiber size distributions, variable density, permeability and surface.

The present invention accomplishes the unique features thereof with a minimum of apparatus, parts, elements, and method steps in both manufacture and maintenance and, at the same time, which allows for ready adjustment to control variable fiber mat density, fiber distribution, mat permeability and surface in selected areas of a produced fibrous mat.

Various other features of the present invention will become obvious to one skilled in the art upon reading the disclosure set forth herein.

BRIEF SUMMARY OF THE INVENTION

More particularly the present invention provides a unified, unique and novel method, apparatus and product arrangement in the production of die attenuated fibrous mat which can be utilized in any number of commercial environments—one of which being the fluid filtration art.

Specifically, the present invention provides a unique and novel method of forming a web of fibrous media comprising: feeding fibers in attenuated multiple fiber layers from a first spaced orifice zone in a first feed path to a first selectively spaced, longitudinally extending, rotating collector zone in successive lower and upper fiber layers, the first fibers having a first selected fiber size distribution when passed to the first collector zone to form a first fibrous mat having a first selected fiber size distribution; feeding the first formed fibrous mat to at least a second similarly rotating collector zone selectively spaced from the first rotating collector zone; feeding second fibers in attenuated multiple fiber layers from a second spaced orifice zone in a second feed path to a second similarly rotating collector zone selectively spaced from the second orifice zone to form a second fibrous mat combined with the first fibrous mat fed to the second collector zone from the first collector zone, the second fibers having a second selected fiber size distribution and, feeding the combined fiber mat from the second collector source zone to a third mat forming zone.

In addition, the present invention provides several embodiments of method steps for controlling the outer surface or surfaces of the web of filter media formed by the novel method embodiments described herein.

Further, the present invention provides in a unified manner, a unique and novel mat of fibrous media comprising: at least a first layered mat portion of selected first fiber size distribution and permeability and at least a second layered mat portion of selected second fiber size distribution, and permeability, both the first and second layered mat portions being of substantially aligned fibers of first and second selected fiber size distributions, and permeabilities with each being attenuated as layers from spaced die sources directly to separate spaced similarly rotating collector sources with one of such sources receiving the layered mat portion from the other of the spaced collector sources.

In addition, the present invention provides apparatus for manufacturing a fibrous mat comprising a first die source including spaced die orifices capable of feeding a first attenuated multiple fiber layered portion; a first selectively gap spaced longitudinally extending first rotating collector surface to eventually receive the totality of the first layered portion; at least a spaced second die source including spaced die orifices capable of feeding a second attenuating multiple fiber layered portion; a second selectively gap spaced longitudinally extending second similarly rotating collector surface to eventually receive the totality of the second fiber layered portion, the second rotating collector surface being spaced from the first rotating collector surface; and, transfer and orientation means positioned between the first and second collector surfaces to orient and transfer the first layered mat portion from the first rotating collector surface to a select quadrant of the second similarly rotating collector surface.

Moreover, the present invention provides several novel rotating collector surface embodiments associated with the unique apparatus described herein to control the nature, permeability and strength of the outer surfaces and the fiber composition therebetween of the novel fibrous media mat described herein.

It is to be understood that various changes can be made by one skilled in the art in the several steps of the method and the several elements and parts of the product and apparatus herein disclosed without departing from the scope or spirit of the present unified invention.

BRIEF DESCRIPTION OF THE DRAWINGS

Referring to the drawings which disclose several advantageous embodiments of the present invention and modifications thereto.

DETAILED DESCRIPTION OF THE DRAWINGS

Figure 1:
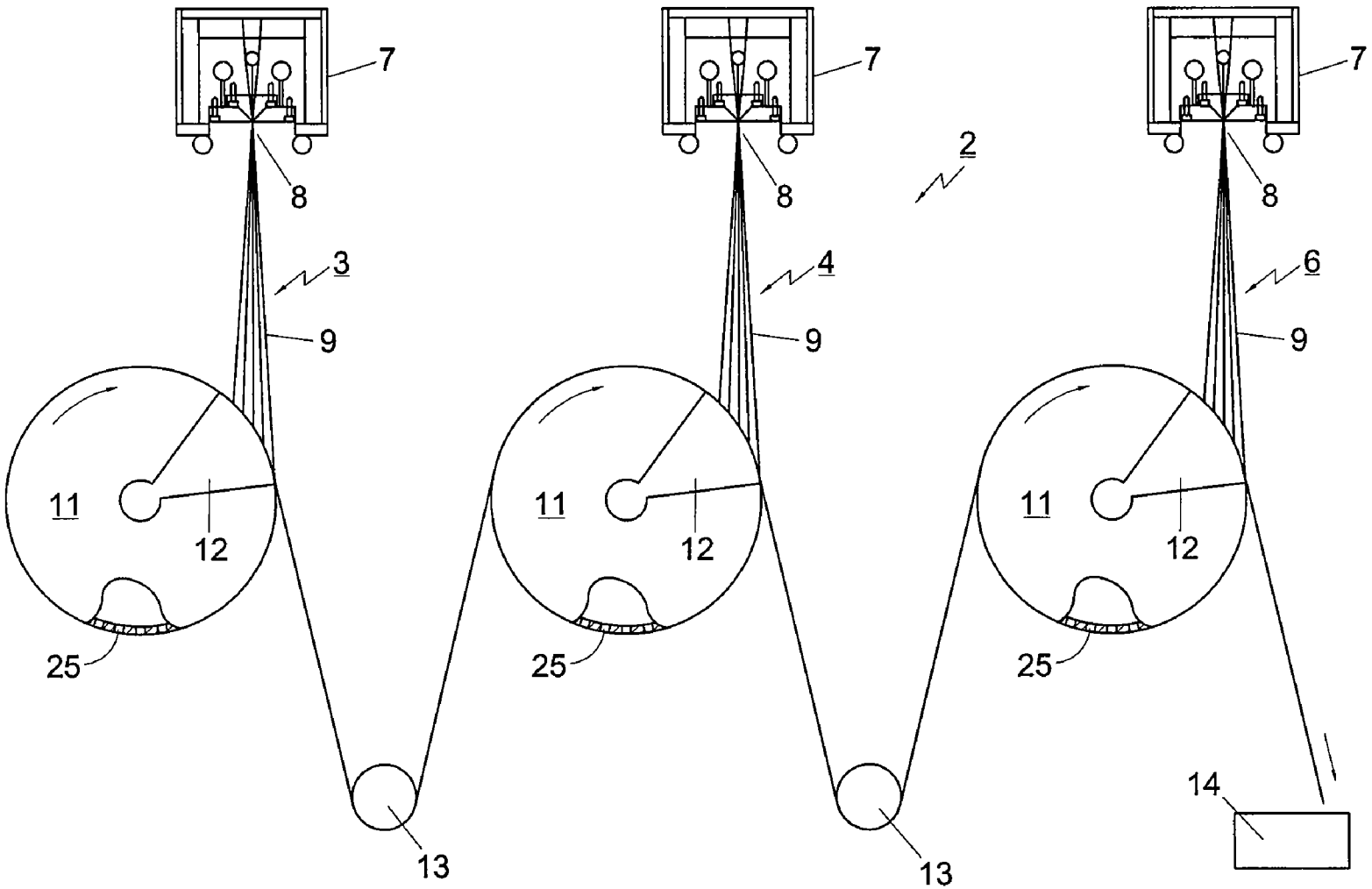
FIG. 1 is a schematic side view of one embodiment of the novel apparatus of the present invention.

Referring to FIG. 1 of the drawings, one embodiment 2 of the novel apparatus of the invention is disclosed for forming the unique layered web of fibrous media in accordance with the inventive overall arrangement described herein.

Figure 1A:
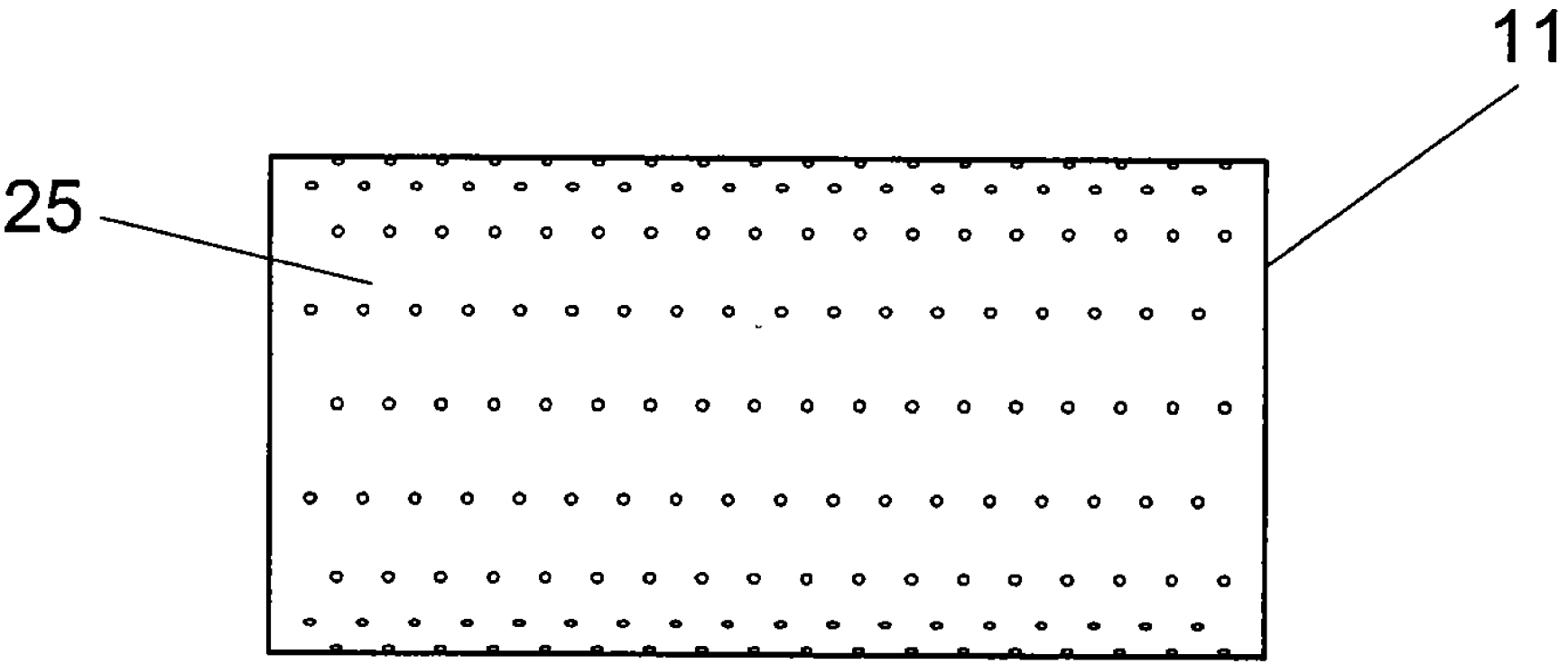
FIG. 1A is a schematic front view of one embodiment of a cylindrical rotatable collector showing a perforated surface.

The overall arrangement of embodiment 2 includes three spaced successive similar fibrous mat forming structures, 3, 4 and 6. Each of these three structures includes a first melt blow die source 7 which includes spaced die orifices 8, each capable of feeding one of three fiber feed paths of attenuated multiple filter fiber layer portions to one of three longitudinally extending, cylindrical rotatable collectors 11, each of which collectors has a peripheral, perforated collector surface 25 selectively spaced from and aligned with the first melt blown die source 7 including spaced die orifices 8. FIG. 1A shows the perforated collector surface 25 of cylindrical rotatable collector 11. A suitable motor and gear driven system (now shown) can be provided to rotate each perforated collector 11 in a selected clockwise rotational direction, as shown by the rotational arrow of FIG. 1. It is to be understood that each perforated rotatable collector 11 eventually receives the selected totality of the filter fiber layered portion from its fiber feed path and that each collector 11 can be provided with an appropriate internal coolant or vacuum source 12, the internal piping and expansive arrangement being disclosed schematically in FIG. 1 and is similar to that as shown in above U.S. Pat. No. 6,159,318 and No. 6,230,775. In an advantageous embodiment of the present Invention collectors 11 can be selectively spaced from die orifices 8 approximately in the range of two (2) to sixty (60) inches and preferably approximately eighteen (18) inches. The polymer volumes and air pressure at the die are appropriately selected for making the particular filter medium.

To accomplish the transfer of layered fiber portions from one spaced, perforated rotating collector 11 to the next adjacent collector 11, longitudinally extending idler rolls 13 are positioned between collectors 11. These idler rolls 13 are positioned relative to the three spaced rotating collectors 11, in accordance with one feature of the present invention, so that the layered mat portion formed on the peripheral surface of a preceding rotatable collector 11 passes from its first cross-sectional quadrant in its rotational direction in oriented fashion along spaced idler rolls 13 to an adjacent rotatable spaced collector 11 so as to be fed to such adjacent rotatable collector 11 along the fourth cross-sectional quadrant that—is advantageously between approximately ninety (90°) degrees of a preceding cross-sectional quadrant to an approximately two hundred seventy (270°) degrees of an adjacent, following collector cross-sectional quadrant.

It is to be understood that, in one embodiment of the present invention, the fibrous layer portion of one fibrous feed path 9 can be superposed above the fibrous layer of another or vice versa—all in accordance with appropriate motor and drive gearing, as well as feed timing (not shown). Also, in accordance with another embodiment of the present invention, it would be possible to selectively intersperse the fibers of the two fibrous layer portions of fibrous feed paths 9.

Further, in other features of the present invention, the fibrous filter media mat formed in portions on the successive mat forming structures, 3, 4, and 6, as above described, which mat is subsequently passed to an additional work forming station (also not shown in detail but shown schematically as block 14) can be of selective composition fiber size distributions, and web permeability.

Advantageously, the first layered filter media mat portion formed by a feed path 9 from die orifices 8 can be of synthetic composition with fiber size distributions, being in the approximate range of zero point one (0.1) to twenty-seven (27) micrometers and the permeability range of five (5) to two thousand (2000) cubic feet per minute per square foot (cfm/ft$^2$). The second layered filter media mat portion formed by a feed path 9 from die orifices 8 can be of similar synthetic melt blown composition with fiber size distributions in the approximate range of one (1) to fifty (50) micrometers and the permeability can be in the approximate range of thirty (30) to four thousand (4000) cubic feet per minute per square foot (cfm/ft2). The third layered portion also can be of similar composition within similar selected fiber size distribution and permeability ranges as the second layered portion.

Figure 2:
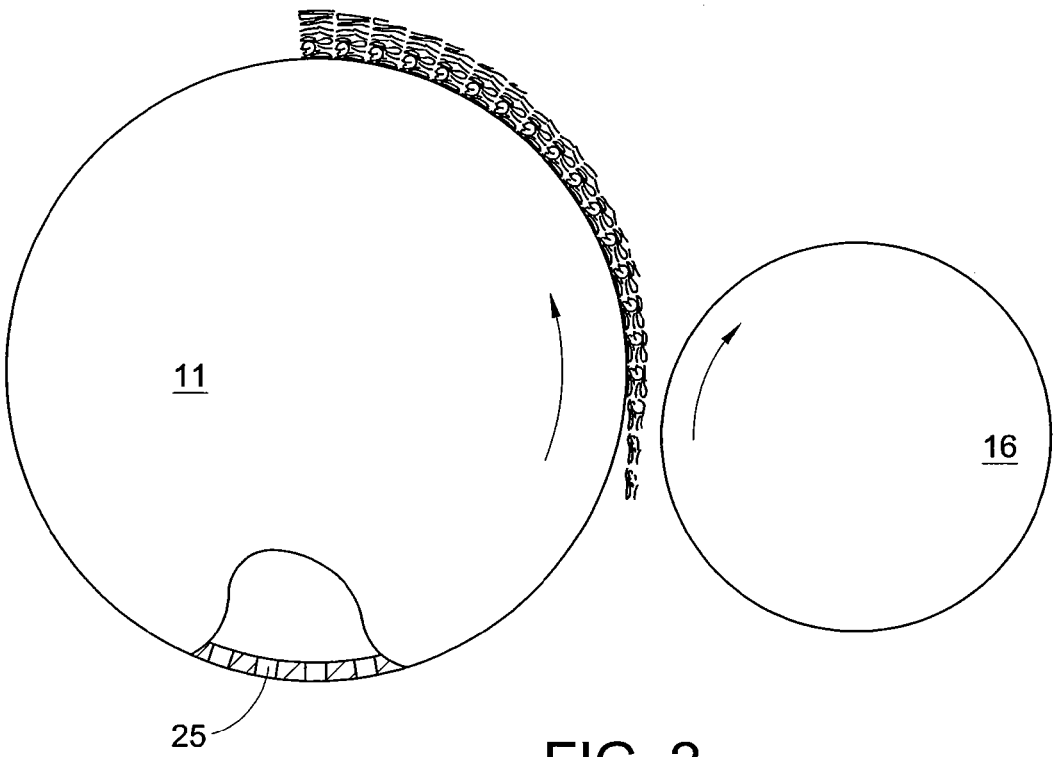
FIG. 2 is a schematic side view similar to that of FIG. 1, further disclosing a novel collector-like vortically creating force deflector.

Referring to FIG. 2 of the drawings, still another additional structural feature of the present invention can be seen. This additional structural feature can be included with any one or more of the mat forming structures 3, 4 and 6 like that shown in FIG. 1, as might be elected and in accordance with the specific nature of a fluid stream to be treated.

In a manner similar to that of co-pending application Ser. No. 09/635,310, filed on Aug. 9, 2000, now U.S. Pat. No. 6,596,205 issued on Jul. 22, 2003, a direction and external vortically creating force in the form of counter-clockwise rotational, cylindrical drum 16, which is of smaller surface than the clockwise rotational cylindrical collector 11 having perforated surface 25. The drum 16 is gap-spaced a preselected distance from collector 11 so as to exert an external vortically creating force on a preselected portion of the multiple fiber sheet before that portion is reformed on collector 11 to join the remaining portions of the multiple fiber sheet. This action of counter-rotational diverter drum 16 serves to curl the fibers when returned to the rotatable collector 11. It is to be understood that the diverting arrangement as shown, as well as such other diverting arrangements disclosed in the aforementioned co-pending application, can be employed with the collectors as shown and with other collectors which might be added to the overall mat forming structures.

In summary and in carrying out one embodiment of the present invention in accordance with the mat forming structures 2, 4 and 6 of FIG. 1 with fibers in the size range of zero point one (0.1) to fifty (50) micrometers as elected for each of the structures 3, 4 and 6, first filter fibers are fed in a first feed zone from spaced melt blow orifices, the first filter fibers being of synthetic melt blown composition with a permeability in the approximate range of five (5) to two thousand (2000) cubic feet per minute per square foot (cfm/ft$^2$) and a fiber size distribution in the approximate range of zero point one (p.1) to twenty seven (27) micrometers, the fibers forming a first portion of a combined filter mat on a first rotating cylindrical collector zone in successive lower and upper first layers in the first zone. The first portion of the mat is then passed through a filter mat orientation feed zone to second and third spaced similarly rotating collector zones to peripherally collect thereon.

More specifically, In the second and third filter zones, fibers which also can be of synthetic melt blown compositions are fed in like feed paths 9 from second and third spaced melt blown orifices 8, the second and third fibers in feed paths 9 having permeability in the approximate range of thirty (30) to four thousand (4000) cubic feet per minute per square foot (cfm/ft2) and fiber size distributions in the approximate range of one (1) to fifty (50) micrometers. The second and third fiber paths 9 are fed to second and third spaced rotating collector zones 11 in successive lower and upper fiber layers or in an interspersed manner with fibers from the preceding zone or zones forming a second and third portions of the combined filter mat with preceding portions of the mat. The combined mat portions are then passed to a further work zone (shown schematically as block 14).

It is to be understood that, if desired, the vortically creating external forces as above discussed, can be employed in one or more of the collecting zones so as to produce curled, entangled fibers, on at least a portion of inventive layered mat. It further is to be understood that in accordance with another feature of the invention that in each of the mat forming structures 3, 4 and 6, the spacing between die orifices 8 and rotating cylindrical collectors 11 in each mat forming structure advantageously is of significant import and advantageously should be in the range of approximately two (2) to sixty (60) inches.

Figure 3:
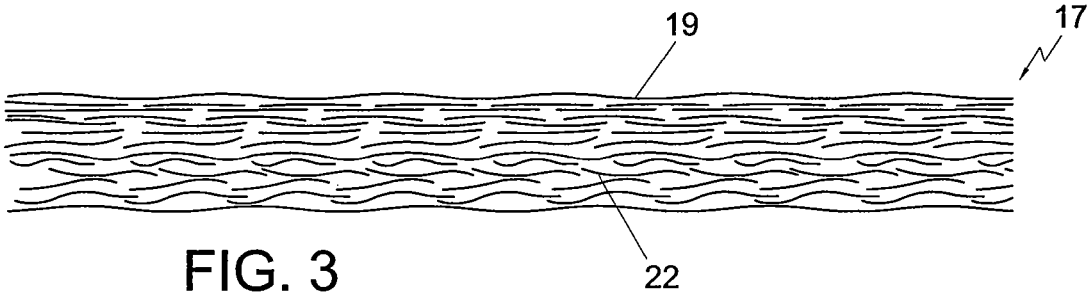
FIG. 3 is a schematic, cross-section of a portion of a novel fibrous mat produced by the novel apparatus of FIG. 1.
Figure 4:
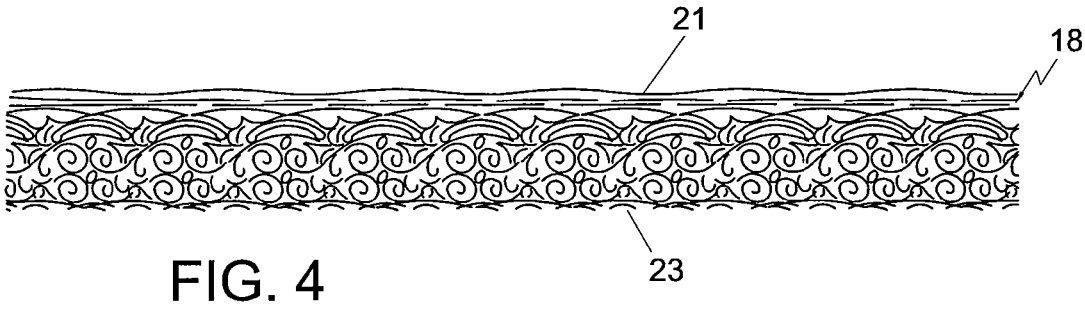
FIG. 4 is another schematic, cross-section of a portion of a novel fibrous mat produced by structure similar to that of FIG. 1 and including the novel apparatus of FIG. 2.

Referring to FIGS. 3 and 4 of the drawings, schematic cross-sections of two fibrous mats 17 and 18 can be seen, fibrous mat 17 having been produced by apparatus similar to that shown in FIG. 1 of the drawings and mat 18 having been produced by apparatus also similar to that shown in FIG. 1 but which also includes a vortically creating force deflector structure (FIG. 2) cooperative with at least one of the rotatable cylindrical drums of the structure of FIG. 1.

It is to be noted in FIGS. 3 and 4 that the outer surfaces 19 and 21, here shown respectively in each of FIGS. 3 and 4 as the upper surface, is of a smooth, skin-like nature as distinguished from the lower surfaces in each figure. This is a consequence of selectively attenuating fibers of a comparatively smaller fiber size distribution into the feed path of either the first or last fibrous producing layers in mat forming structures 3 or 6.

It is to be understood that either the first, last or both such end fibrous mat producing layer structures can be so arranged to produce such a desired outer surface with the final mat produced work product at 14 being appropriately inverted, as might be occasioned.

It further is to be noted in FIGS. 3 and 4 that the lower layers 22 and 23 of mats 17 and 18 respectively are selectively of coarser nature, the attenuated fibers being of comparatively greater fiber size distribution. Moreover, lower layer 23 of FIG. 4 is shown as entangled as the consequence of the aforedescribed vertical force filter displacement by counter-rotating small drum structure as shown in FIG. 2.

Figure 6:
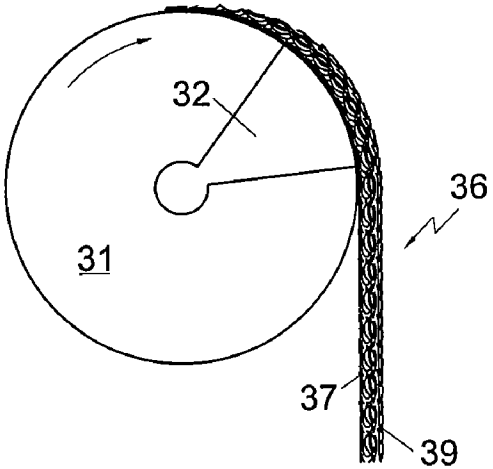
FIG. 6 is a schematic cross sectional side view of a fibrous mat produced by the arrangement of FIG. 5.
Figure 5:
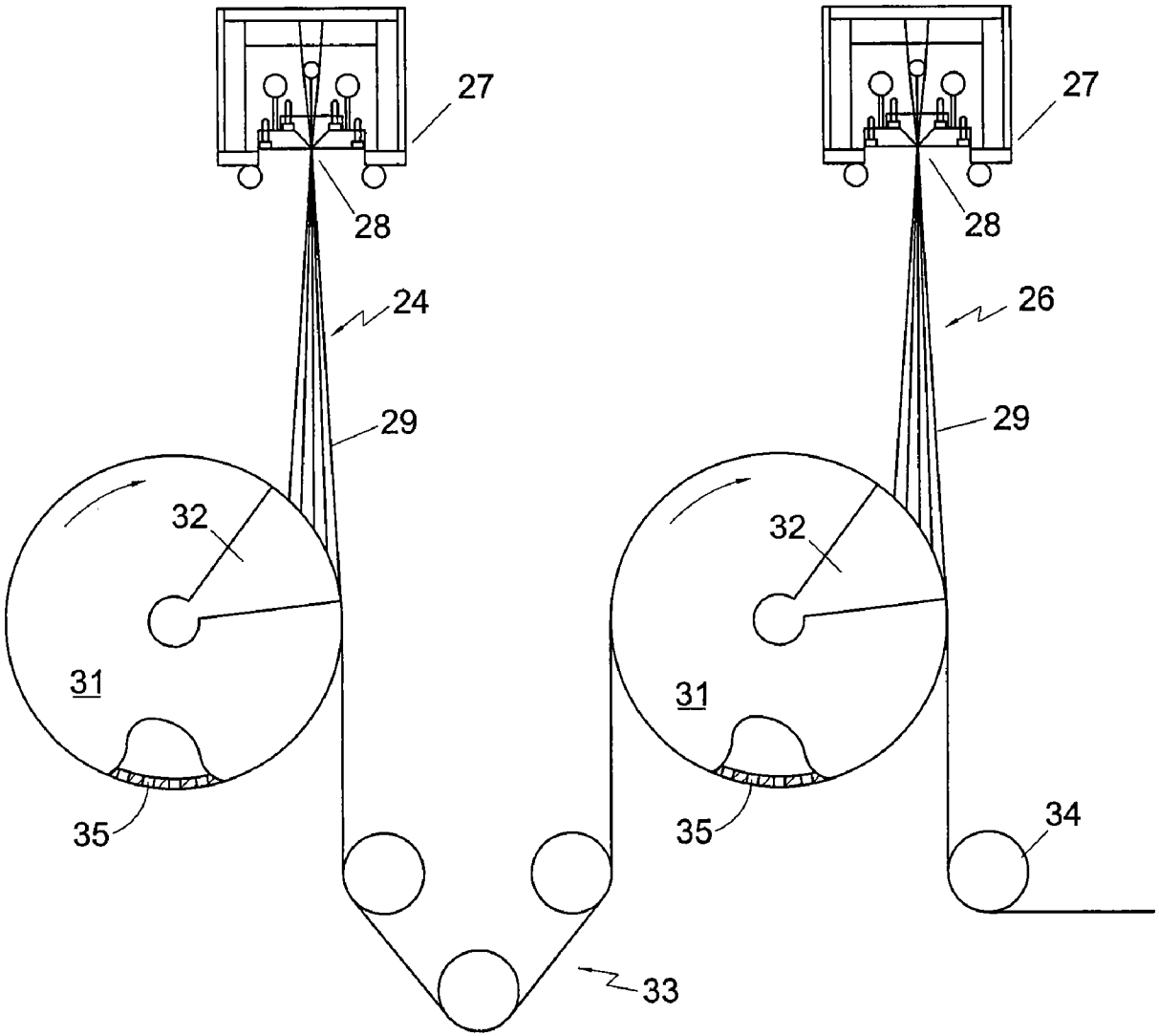
FIG. 5 is a schematic side view of a second embodiment of the novel apparatus of the present invention.

In FIGS. 5 and 6, another embodiment of the present invention can be seen. In this embodiment, spaced mat forming structures 24 and 26 are disclosed. Each mat forming structure includes a melt blown die source 27 with die orifices 28 adapted to have attenuated therefrom fiber feed paths 29 unto spaced, cylindrical, fluid pervious, rotatable cylindrical collectors 31, each collector including coolant or vacuum piping with expanders 32 at the distal end and a perforated surface 35. A triangularly spaced idler roller set 33 is positioned between the two spaced fluid pervious rotatable, cylindrical collectors 31 and an idler roller 34 is positioned below the later of collectors 31 to receive and direct the layered fibrous mat to a following location. In this embodiment of the invention, only two spaced rotatable collectors 31 are disclosed. These perforated collectors 31, like the three spaced perforated collectors 11 of FIG. 1, are shown to rotate in the same direction and to receive fiber feed paths 29 attenuated from orifices 28 in the first cross-sectional quadrant of each collector in a manner similar to the feed paths 9 and collectors 11 arrangement of FIG. 1.

The resulting layered melt blown fibrous mat 36 can be seen in the schematic cross-sectional drawing (FIG. 6) to include a smooth skin-like outer surface 37 formed by the finer attenuated fiber layer 38 having comparatively smaller fiber size distribution than the coarser attenuated fiber layer 39.

Figure 7:
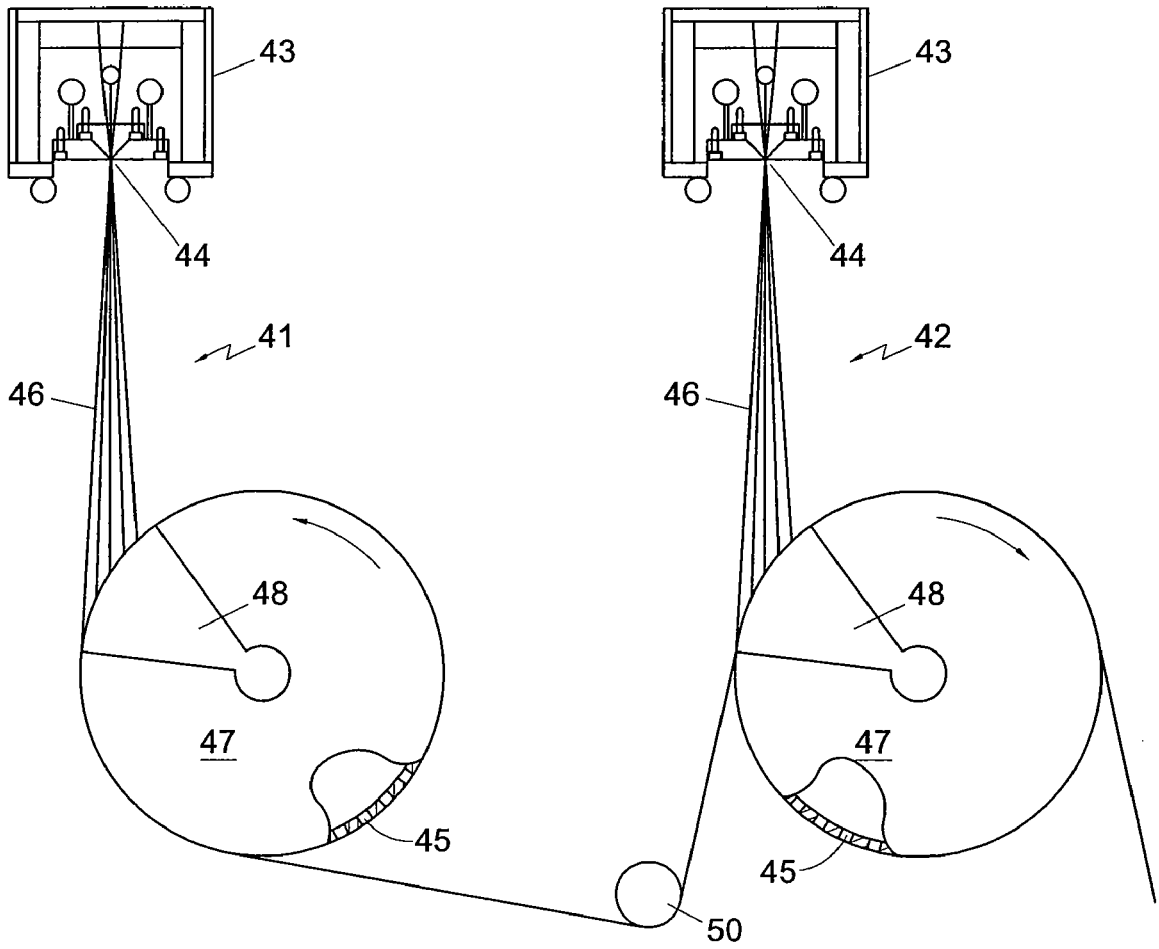
FIGS. 7 and 8 are schematic side views of a third embodiment of the novel apparatus and cross-sectional side view of the fibrous mat produced thereby.
Figure 8:
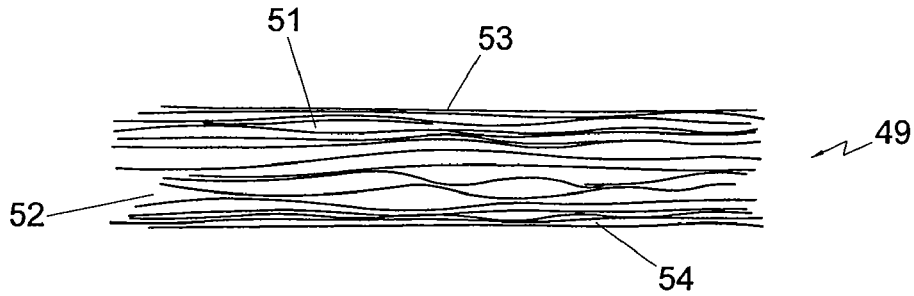

Referring to FIGS. 7 and 8, still another embodiment of the present invention can be seen. In this embodiment, spaced mat forming structures 41 and 42 can be seen. Each structure includes a melt blown die source 43 with die orifices 44 serving to have attenuated therefrom fiber feed paths 46 unto spaced cylindrical, fluid pervious rotatable cylindrical collectors 47 having perforated collector surfaces 45, each collector including coolant or vacuum piping with a distal expanders 48--the structure described so far being comparable to that structure of FIGS. 5 and 6 except for a single idler roll 50 being positioned between the spaced rotating collectors 47 and except for the fact that the cylindrical rotatable collectors 47 are rotated in opposite directions from each other. It also is to be noted in this embodiment of the invention that the fiber feed paths 46 are directed to the fourth cross-sectional quadrant of the collectors as distinguished from the first cross-sectional quadrant--as can be seen in FIGS. 1 and 5.

In the embodiment of the invention of FIG. 7 and as can be seen in FIG. 8 disclosing a schematic cross-sectional view of a layered fibrous mat 49 produced by the mat forming arrangement of FIG. 7, fine fiber layers 51 and coarse fiber layers 52 are shown with both outer surfaces 53 and 54 having comparatively smooth, skin-like properties. As above discussed, the finer fibers of layers 51 have comparatively smaller fiber size distribution properties than the coarser layers 52.

Figure 9:
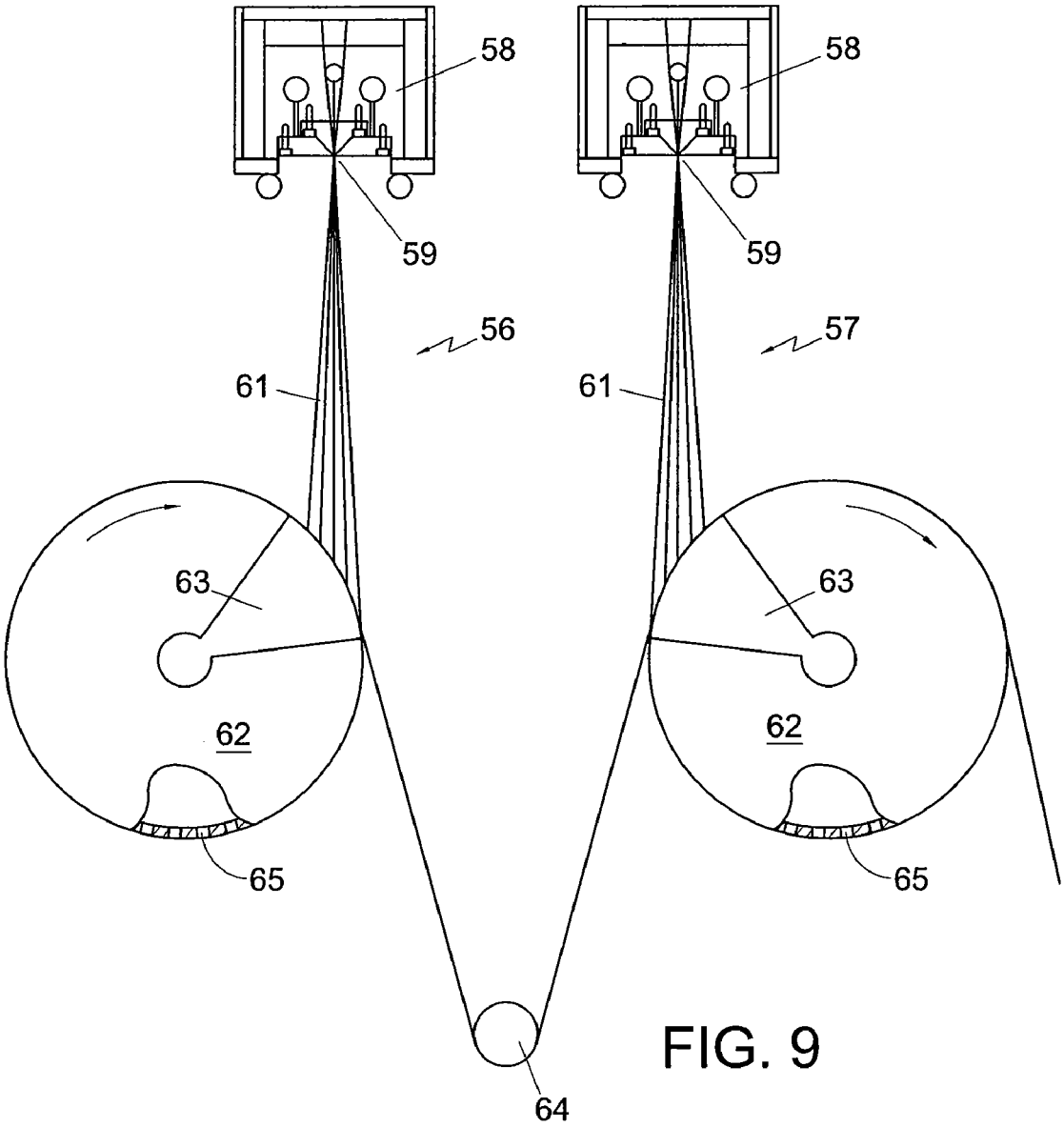
FIGS. 9 and 10 are views like FIGS. 5–8 disclosing a fourth embodiment of the present invention.
Figure 10:
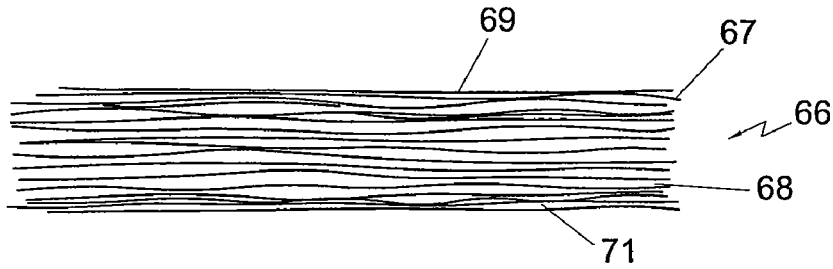

In still another embodiment of the invention as disclosed in FIGS. 9 and 10 of the drawings, mat forming structures 56 and 57 can be seen. Like that of FIG. 7 each structure 56 and 57 includes a melt blown die source 58 with the die orifices 59 serving to have attenuated therefrom fiber feed paths 61 unto spaced cylindrical, fluid pervious, rotatable cylindrical spaced collectors 62, each collector including coolant or vacuum piping with a distal expander 63 in flow communication with perforated surface 65.

In this embodiment of FIG. 9, the spaced collectors 62 are shown as rotating in the same direction. However, the fiber feed path 61 in the mat forming structure 56 is directed to the cross-sectional first quadrant of rotatable collector 62 whereas the fiber feed path 61 in mat forming structure 57 is directed to the cross-sectional fourth quadrant of its rotatable collector 62. A suitable idler roll 64 is shown positioned between spaced rotatable collectors 62 to direct the produced fibrous layers from one rotatable collector 62 to the other spaced fluid pervious rotatable collector 62.

As above, the produced fiber layers can be of coarse and fine fibers with the fine fibers of one fiber feed path 61 having a smaller fiber size distribution than the fiber feed path of the other fiber feed path 61.

Referring to FIG. 10, the cross-section of a portion of a fibrous matt 66 can be seen as produced by and arrangement such as disclosed in FIG. 9. This mat is shown as including layers 67 of fine fibers and layers of coarse fibers 68. In this embodiment, both outer surfaces 69 and 71 have been formed so as to be of smooth, skin-like nature.

Figure 11:
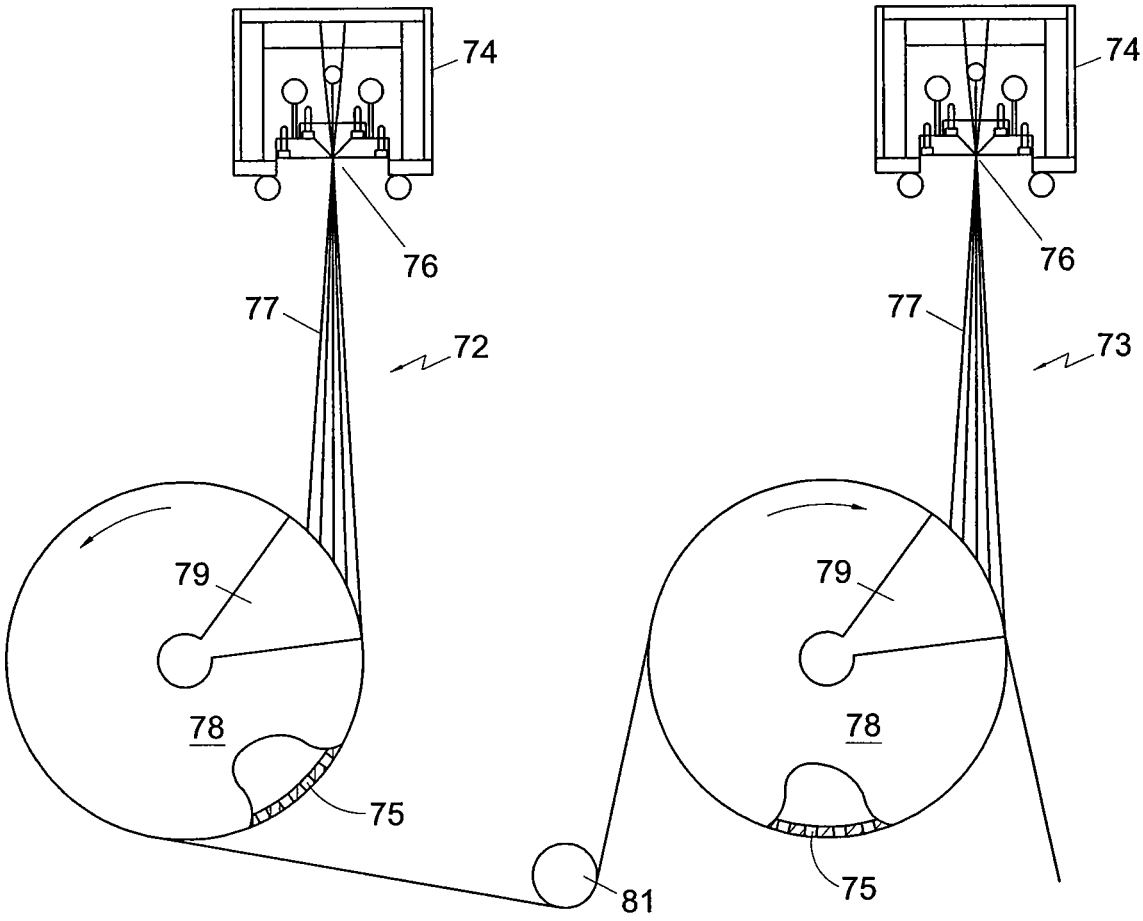
FIGS. 11 and 12 are views similar to FIGS. 5–10, disclosing a fifth embodiment of the present invention; and, FIG. 13 is a schematic chart disclosing the comparative bond strength in pounds from spaced stations extending from edge to edge of a fibrous mat of the present invention when compared with two commercially competitive fibrous mats.
Figure 12:
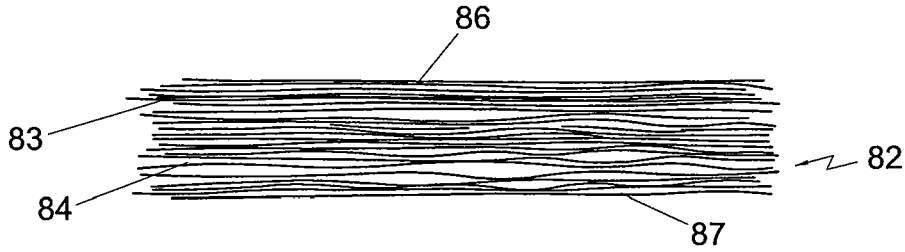

FIGS. 11 and 12 show still a further embodiment of the present unified invention FIG. 11 is shown to include melt blown mat forming structures 72 and 73, each of which includes melt blown die source 74 with die orifices 76 serving to have attenuated therefrom fiber feed paths 77 unto spaced, cylindrical, fluid pervious, rotatable cylindrical collector 78 having perforated surfaces 75. As above, for FIG. 9, each collector 78 includes coolant or vacuum piping with a distal expander 79.

In this FIG. 11 the spaced rotatable, cylindrical collectors are shown as rotatable in opposite directions with fiber feed paths 77 being directed to the first cross-sectional quadrant of each rotatable collector. A suitable idler roll 81 can be seen positioned between spaced collectors 78.

In the embodiment of FIG. 12, fiber attenuation paths 77 for mat forming structures 72 and 73 can be of coarse and fine fibers, respectively with the finer fibers having a smaller fiber size distribution than the coarser fibers.

Referring to FIG. 12, the cross-section of a portion of a fibrous mat 82 can be seen as produced by an arrangement such as disclosed in FIG. 11. This mat 82 is shown as including layers 83 of fine fibers and layers of coarse fibers 84. As in FIG. 10, both outer surfaces 86 and 87 have been formed so as to be of smooth, skin-like nature.

This, in accordance with the several embodiments of the unified invention disclosed, it can be seen that relatively strong webs of fiber medium can be produced form spaced die attenuating structures advantageously of the melt blown type but not necessarily limited thereto with fiber feed paths feeding attenuated fibers of selective fine and coarser nature over a selective distance and in a selectively contacting manner to spaced rotatable cylindrical collectors which, in the several embodiments disclosed, can be rotated in different manners with respect to each other. The resulting fibrous mat products—which are particularly suited for fluid filtration, provide a number of unique and novel features to the filtration art, including controlled outer smooth, skin-like fibrous mat surfaces which serve to minimize the amount of loose fibers on the web surface. And, as can be seen in FIG. 13, the fibrous mat of the present invention provides an increased bond strength in pounds when the inventive mat is compared to two well known other fibrous mats which are now available on the commercial market.

Figure 13:
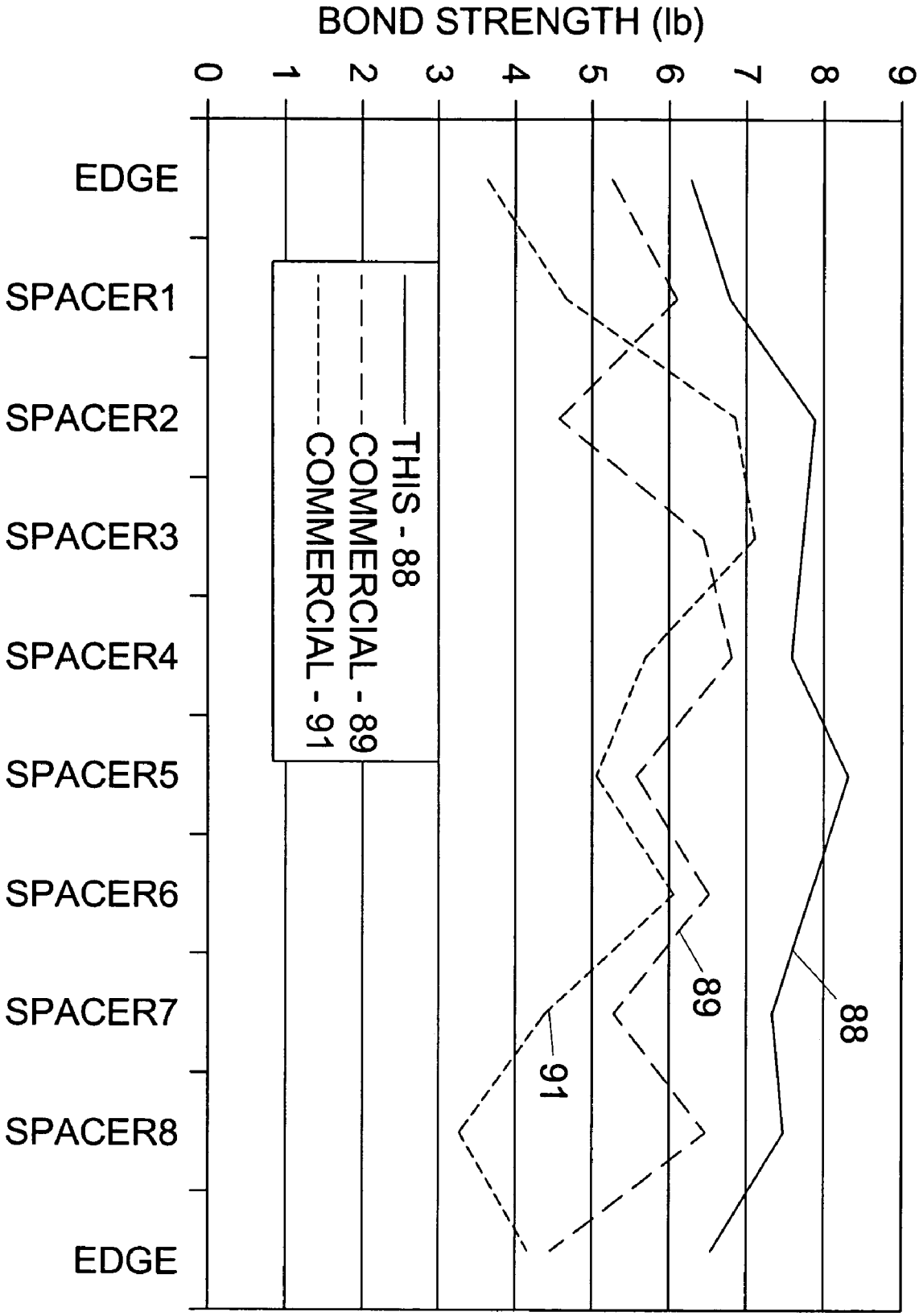

In this regard, the chart of FIG. 13, compares bond strengths in pounds across eight (8) edge-to-edge spacer stations of an inventive fibrous mat product as represented by the full line 88 when compared in performance with the two other commercially available fibrous mat products represented by longer dash line 89 and the shorter dash line 91.

The invention claimed is:

1. Apparatus for manufacturing a fibrous mat comprising a first die source including spaced die orifices capable of feeding a first attenuated multiple fiber layered portion; a first selectively gap spaced longitudinally extending cylindrical first rotating self propelled collector surface to receive said first layered portion; a spaced second die source including spaced die orifices capable of feeding a second attenuating multiple fiber layered portion; a second gap spaced longitudinally extending cylindrical second rotating self propelled collector surface to receive said second fiber layered portion, said second rotating collector surface being spaced a distance in excess of the thickness of said first layered mat portion; and at least one idle roller positioned between and spaced from said first and second collector surfaces a distance in excess of the thickness of said first layered mat portion to orient and transfer said first layered mat portion from said first rotating collector surface to said second rotating collector surface.

2. The apparatus for manufacturing a fibrous mat of claim 1, and at least one layered mat diverting apparatus positioned externally of one of said die sources to apply an external vortically creating force on part of one of said fiber layered portions before said portion reaches said cooperative rotating collecting source for said layered portion.

3. Apparatus for manufacturing a fiber filter mat comprising: a first melt blown die source including spaced die orifices capable of feeding a first attenuated multiple filter fiber layer portion; a first longitudinally extending self propelled rotatable collector surface spaced from and aligned off center from a longitudinal axis with said first die source to eventually receive said first attenuated filter fiber portion; a spaced second melt blown die source including spaced die orifices capable of feeding a second attenuated multiple filter fiber portion; a second longitudinally extending self propelled rotatable collector surface spaced from and aligned off center from a longitudinal axis with said second die source to receive said second attenuated filter fiber portion, said first die source and said aligned first rotatable collector being spaced from said second die source and said aligned second rotatable collector; a plurality of spaced longitudinally extending idler rollers positioned between and apart from said first and second rotatable collectors a distance in excess of the thickness of said first mat portion and said second mat portion respectively to orient and transfer said first layered mat portion from said first rotatable collector surface from a first selected cross-sectional quadrant to a second selected cross-sectional quadrant of said second rotatable collector surface; and at least one small collector diverter positioned in spaced relation to one of said die sources to apply an external vortically creating force to part of one of said fiber layered portions before said portion reaches said cooperative rotatable collector collecting surface for said portion, and, an additional work station positioned downstream said second rotatable collector to receive combined first and second mat portions.

4. Apparatus for manufacturing a fiber filter mat comprising:

at least two spaced successive melt blown die sources wherein each of said at least two spaced successive melt blown die sources have at least one spaced die orifice;

at least two longitudinally extending cylindrical rotatable collectors wherein one of said at least two longitudinally extending cylindrical rotatable collectors is aligned and selectively spaced from each of said at least two spaced successive melt blown die sources;

a motor and gear driven system in mechanical communication with each of said at least two longitudinally extending cylindrical rotatable collectors providing a rotational force to each of said at least two longitudinally extending cylindrical rotatable collectors making said collectors self propelled; and at least one longitudinally extending idler roller, wherein at least one of said at least one longitudinally extending idler roller is positioned between and spaced from said rotatable collectors a distance in excess the thickness of a first mat portion each of said at least two longitudinally extending cylindrical rotatable collectors.

5. The apparatus for manufacturing a fiber filter mat of claim 4 wherein each of said at least two longitudinally extending cylindrical rotatable collectors has a perforated collector surface.

6. The apparatus for manufacturing a fiber filter mat of claim 5 wherein each of said at least two longitudinally extending cylindrical rotatable collectors has vacuum source in flow communication thereto.

7. The apparatus for manufacturing a fiber filter mat of claim 4 wherein each of said at least two longitudinally extending cylindrical rotatable collectors has an internal coolant.

8. The apparatus for manufacturing a fiber filter mat of claim 4 further having a vortically force creating rotational cylindrical drum gap-spaced at preselected distance from at least one of said at least two longitudinally extending cylindrical rotatable collectors, said vortically force creating rotational cylindrical drum having a motor and gear driven system in mechanical communication thereto providing a rotational force in an opposite direction as said rotational force being applied to the said at least one longitudinally extending cylindrical rotatable collector to which said vortically force creating rotational cylindrical drum is gap-spaced therefrom.

9. The apparatus for manufacturing a fiber filter mat of claim 4 wherein said at least one of said at least one longitudinally extending idler rollers positioned between each of said at least two longitudinally extending cylindrical rotatable collectors is three idler rollers arranged in a substantially triangular configuration.

10. The apparatus for manufacturing a fiber filter mat of claim 4 wherein each of said at least two longitudinally extending cylindrical rotatable collectors being aligned and selectively spaced from each of said at least two spaced successive melt blown die sources are selectively spaced approximately in a range of 2 to 60 inches.

11. The apparatus for manufacturing a fiber filter mat of claim 10 wherein each of said at least two longitudinally extending cylindrical rotatable collectors being aligned and selectively spaced from each of said at least two spaced successive melt blown die sources are selectively spaced at approximately 18 inches.

12. The apparatus for manufacturing a fiber filter mat of claim 4 wherein each of said at least two spaced successive melt blown die sources is aligned above a first cross-sectional quadrant, between 0° and 90°, of each of said at least two longitudinally extending cylindrical rotatable collectors.

13. The apparatus for manufacturing a fiber filter mat of claim 4 wherein a first of said at least two spaced successive melt blown die sources is aligned above a fourth cross-sectional quadrant, between 270° and 360°, of a first of said at least two longitudinally extending cylindrical rotatable collectors and a second of said at least two spaced successive melt blown die sources is aligned above a first cross-sectional quadrant, between 0° and 90°, of a second of said at least two longitudinally extending cylindrical rotatable collectors.

14. The apparatus for manufacturing a fiber filter mat of claim 4 wherein a first of said at least two spaced successive melt blown die sources is aligned above a first cross-sectional quadrant, between 0° and 90°, of a first of said at least two longitudinally extending cylindrical rotatable collectors and a second of said at least two spaced successive melt blown die sources is aligned above a fourth cross-sectional quadrant, between 270° and 360°, of a second of said at least two longitudinally extending cylindrical rotatable collectors.

15. The apparatus for manufacturing a fiber filter mat of claim 4 wherein a first of said at least two spaced successive melt blown die sources is aligned above a fourth cross-sectional quadrant, between 270° and 360°, of a first of said at least two longitudinally extending cylindrical rotatable collectors and a second of said at least two spaced successive melt blown die sources is aligned above a fourth cross-sectional quadrant, between 270° and 360°, of a second of said at least two longitudinally extending cylindrical rotatable collectors.

16. The apparatus for manufacturing a fiber filter mat of claim 4 wherein a work station is positioned downstream from a final of said at least two longitudinally extending cylindrical rotatable collectors.

17. An apparatus for manufacturing a fiber filter mat comprising:

a first and second self propelled cylindrical rotatable collector having cylindrical axes substantially horizontally aligned and having a space there between;

a first and second die source, said first die source being positioned above said first rotatable collector and angularly aligned off center from a longitudinal axis thereof feeding a first mat portion onto said first rotatable collector and said second die source being positioned above said second rotatable collector and angularly aligned off center from a longitudinal axis thereof feeding a second mat portion onto said second rotatable collector, said space between said first and said second rotatable collectors being in excess of a thickness of said first mat portion; and at least one cylindrical rotatable idler roller having a cylindrical axis substantially horizontally aligned below and apart from said cylindrical axes of said first and second cylindrical rotatable collectors and having a cylindrical surface between cylindrical surfaces of said first and second cylindrical rotatable collectors.

18. The apparatus for manufacturing a fiber filter mat of claim 17 wherein said first and second cylindrical rotatable collectors have vacuum source and perforated cylindrical surfaces.

19. The apparatus for manufacturing a fiber filter mat of claim 17 wherein said first and second cylindrical rotatable collectors have a cooling source.

20. The apparatus for manufacturing a fiber filter mat of claim 17 wherein said first and second cylindrical rotatable collectors are respectively spaced below said first and second die sources in a range of approximately two to sixty inches.

* * * * *